US009200441B1

(12) United States Patent
Straight et al.

(10) Patent No.: US 9,200,441 B1
(45) Date of Patent: Dec. 1, 2015

(54) SEISMIC WALL SUPPORT FOR SUSPENDED GRID

(71) Applicant: USG Interiors, LLC, Chicago, IL (US)

(72) Inventors: Yelena Straight, North Buffalo Grove, IL (US); James J. Lehane, McHenry, IL (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 14/462,671

(22) Filed: Aug. 19, 2014

(51) Int. Cl.
*E04B 9/30* (2006.01)
*E04B 1/98* (2006.01)
*E04B 9/18* (2006.01)

(52) U.S. Cl.
CPC ... *E04B 1/98* (2013.01); *E04B 9/18* (2013.01); *E04B 9/30* (2013.01); *E04B 2009/186* (2013.01)

(58) Field of Classification Search
CPC ..... E04B 1/98; E04B 9/18; E04B 9/30; E04B 2009/186
USPC ..... 52/167.1, 167.3, 506.06, 506.08, 52/506.07, 836, 846, 854, 855
See application file for complete search history.

(56) References Cited

U.S. PATENT DOCUMENTS

| | | | | |
|---|---|---|---|---|
| 3,798,865 | A * | 3/1974 | Curtis | 52/665 |
| 3,861,105 | A * | 1/1975 | Starks | 52/506.07 |
| 4,479,341 | A * | 10/1984 | Schuplin | 52/665 |
| 5,046,294 | A * | 9/1991 | Platt | 52/506.06 |
| 5,195,289 | A * | 3/1993 | LaLonde et al. | 52/506.06 |
| 5,197,247 | A * | 3/1993 | Elderson | 52/288.1 |
| 5,937,605 | A * | 8/1999 | Wendt | 52/506.06 |
| 6,516,581 | B2 * | 2/2003 | Paul et al. | 52/506.07 |
| 7,240,460 | B2 * | 7/2007 | Platt | 52/506.07 |
| 7,278,243 | B2 * | 10/2007 | Jones et al. | 52/506.07 |
| 7,574,838 | B2 * | 8/2009 | Maisch et al. | 52/506.07 |
| 7,743,572 | B2 * | 6/2010 | Ducharme | 52/506.06 |
| 7,779,593 | B2 * | 8/2010 | Jahn et al. | 52/506.06 |
| 7,788,875 | B2 * | 9/2010 | Wendt | 52/712 |
| 7,841,149 | B2 * | 11/2010 | Jahn et al. | 52/506.08 |
| 7,930,864 | B2 * | 4/2011 | Wendt | 52/712 |
| 8,397,458 | B2 * | 3/2013 | Tedesco et al. | 52/506.05 |
| 8,453,407 | B2 | 6/2013 | Tedesco et al. | |
| 2004/0172907 | A1 * | 9/2004 | Krantz-Lilienthal et al. | 52/506.05 |

(Continued)

FOREIGN PATENT DOCUMENTS

| | | | |
|---|---|---|---|
| FR | 2740800 | A1 | 5/1997 |
| JP | 2013-238026 | A | 11/2013 |

OTHER PUBLICATIONS

"Corridor Installations and the Armstrong SingleSpan Solution" brochure, 10 pgs., Copyright 2011 AWI Licensing Company.

(Continued)

*Primary Examiner* — Brent W Herring
(74) *Attorney, Agent, or Firm* — Pearne & Gordon LLP

(57) ABSTRACT

A seismic duty support system for a suspended ceiling at a wall intersection comprising a roll formed sheet metal wall molding, the wall molding having a vertical element and a horizontal element unitary with the vertical element at an upper edge of the vertical element, a plurality of supports regularly spaced along a length of the wall molding, the supports being attached to and extending perpendicularly from the vertical element, each of said supports lying in a vertical plane, each support having a hole distal from the vertical element for cooperating with a tension element connected to the end of an underlying grid runner.

4 Claims, 4 Drawing Sheets

(56) References Cited

U.S. PATENT DOCUMENTS

| | | | | |
|---|---|---|---|---|
| 2005/0081467 | A1 | 4/2005 | Fontaine | |
| 2006/0005493 | A1* | 1/2006 | Burns et al. | 52/506.01 |
| 2006/0010812 | A1* | 1/2006 | Jones et al. | 52/506.07 |
| 2008/0086962 | A1* | 4/2008 | Jahn et al. | 52/220.6 |
| 2008/0229680 | A1* | 9/2008 | Jahn et al. | 52/105 |
| 2009/0301010 | A1 | 12/2009 | Kelly et al. | |
| 2010/0107518 | A1* | 5/2010 | Heath | 52/167.3 |
| 2011/0146194 | A1* | 6/2011 | Tedesco et al. | 52/665 |
| 2012/0042584 | A1 | 2/2012 | Sareyka | |
| 2012/0167515 | A1* | 7/2012 | Boyd | 52/506.07 |
| 2013/0227907 | A1* | 9/2013 | Gulbrandsen et al. | 52/665 |
| 2014/0000205 | A1* | 1/2014 | Underkofler et al. | 52/588.1 |
| 2015/0033641 | A1* | 2/2015 | Satoh et al. | 52/167.1 |

OTHER PUBLICATIONS

International Search Report and the Written Opinion of the International Searching Authority dated Oct. 6, 2015, issued in PCT/US2015/043925, filed Aug. 6, 2015.

* cited by examiner

SEISMIC WALL SUPPORT FOR SUSPENDED GRID

BACKGROUND OF THE INVENTION

The invention relates to accessories for suspended ceilings particularly useful in seismic zones.

PRIOR ART

Various arrangements have been proposed to reduce the risk of suspended ceiling grid elements slipping off a wall angle at the periphery of a suspended ceiling during a seismic event. U.S. Pat. No. 8,453,407 discloses an example of a clip that can permit limited movement of the end of a grid runner off a wall angle without the grid runner falling. In some seismic zones, this type of clip may be deemed inadequate. Building codes may, for example, require that a grid runner at a ceiling perimeter be supported by an overhead wire within 8 inches of the respective wall and that the wire not be off vertical or plum more than 8.5 degrees. These requirements can often be difficult to satisfy, particularly where the wall rises only a limited distance above the plane of the ceiling. Even when the respective wall rises well above the ceiling, there may not be a practical or convenient manner of attaching a wire to the wall or wall framing.

SUMMARY OF THE INVENTION

The invention provides a wire or strap support for securing grid runner ends against accidental fall-off of a wall angle in the event of seismic activity. The support stands off a wall on which it is installed making the support readily accessible for installation of a suspension wire and reducing the required height above the ceiling plane to satisfy angle restrictions on the suspension wire or strap element.

In one embodiment of the invention, the standoff supports are stamped from and integral with the body of a sheet metal wall molding. The supports can be factory stamped out on 8 inch centers, for example, successively along the length of the wall molding. The supports can be left in the plane of the body of the molding. At the time of installation, certain ones of the supports can be selected and bent out of the plane of the associated part of the molding from which they were cut. The wall molding can be attached to a wall a short distance above the plane of the ceiling.

In another embodiment of the invention, a clip provides a standoff support for a suspension wire or the like. The clip preferably has a mounting part adapted to snap into engagement with a wall molding at a selected position along the length of the molding. As with the first-described embodiment, the wall molding need only be spaced a limited distance above the plane of the ceiling to avoid too great an angle from the vertical of the suspension element.

The disclosed supports enable the grid runners to be properly supported with reduced labor time and skill. Both embodiments of this invention allow the grid runners to be located on centers that are independent of the stud locations of the wall they intersect.

DESCRIPTION OF THE PREFERRED EMBODIMENTS

Figure 1:
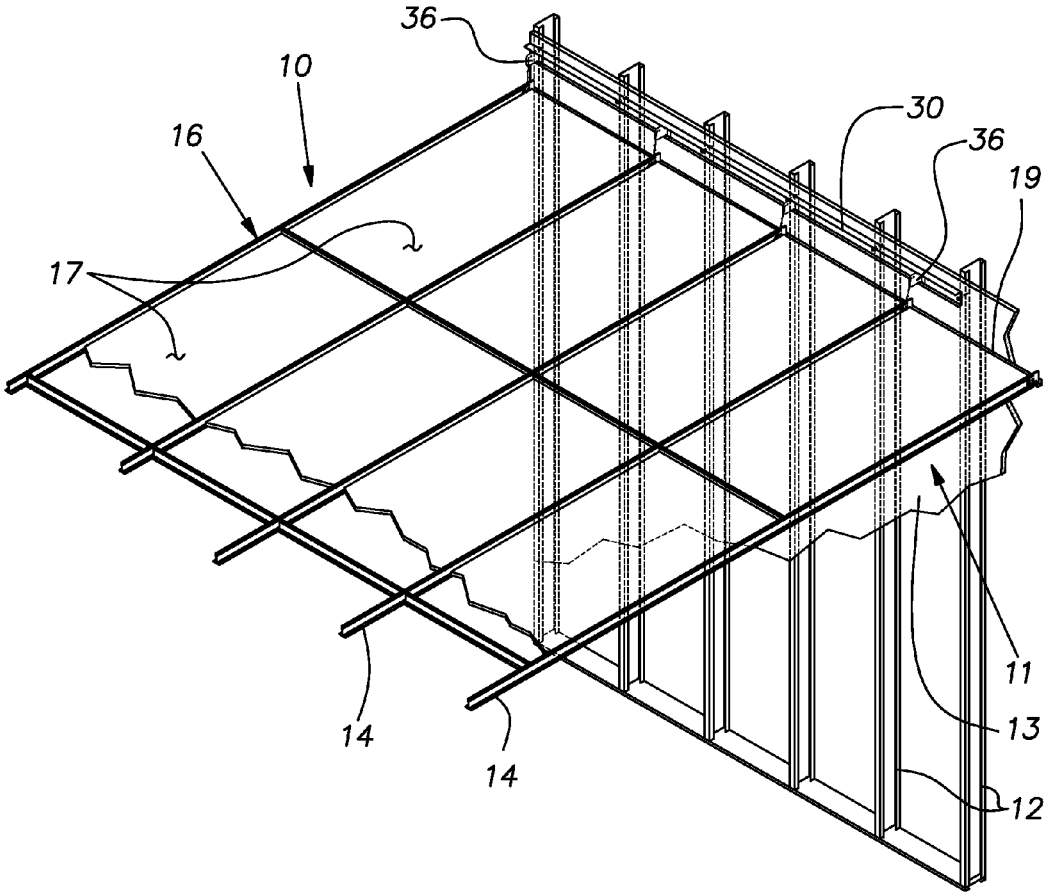
FIG. 1 is a diagrammatic perspective view of a ceiling installation according to the invention.

FIG. 1 shows a suspended ceiling installation 10 where it intersecting a wall 11. In the illustrated case, the wall 11 is constructed of sheet metal studs 12 covered with drywall panels 13. The studs 12 and drywall 13 extend a limited distance above the plane of the ceiling 10. In a conventional manner, the ceiling comprises grid runners 14, ordinarily in the shape of inverted tees, forming a rectangular grid 16. Ceiling tiles 17 are disposed in spaces between the grid runners 14. Typically, main runners 14 of the grid 16 are suspended from overhead structure with wires on 4 foot centers. Throughout this disclosure, dimensions given in English units will be understood to extend to standard industry metric equivalents of such dimensions.

The ends of the runners 14 which essentially intersect the wall 11, are disposed on a horizontal flange 18 of a wall angle 19 having a vertical flange 20 attached to the wall 11. In seismic zones, a sheet metal clip 26, such as disclosed in aforementioned U.S. Pat. No. 8,453,407 may be assembled on the end of a grid runner 14. The clip 26 can be attached to the wall angle 19 by positioning depending tabs 27 of the clip 26 over the vertical flange or leg 20 of the wall angle. In certain seismic zones, there may be a need for a more positive support of a grid runner 14 at the wall 11 than is afforded by the clip 26.

Figure 2:
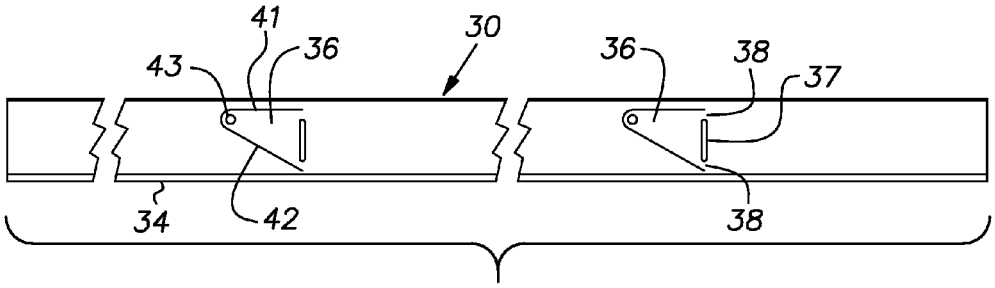
FIG. 2 is a fragmentary front view of a wall molding according to a first embodiment of the invention.
Figure 3:
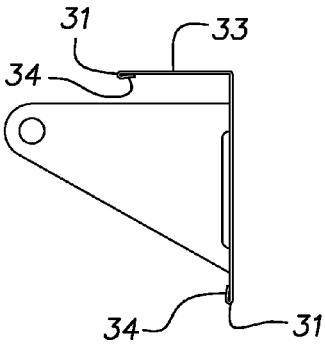
FIG. 3 is an end view of the wall molding of FIG. 2 showing a deployed standoff wire support.
Figure 4:
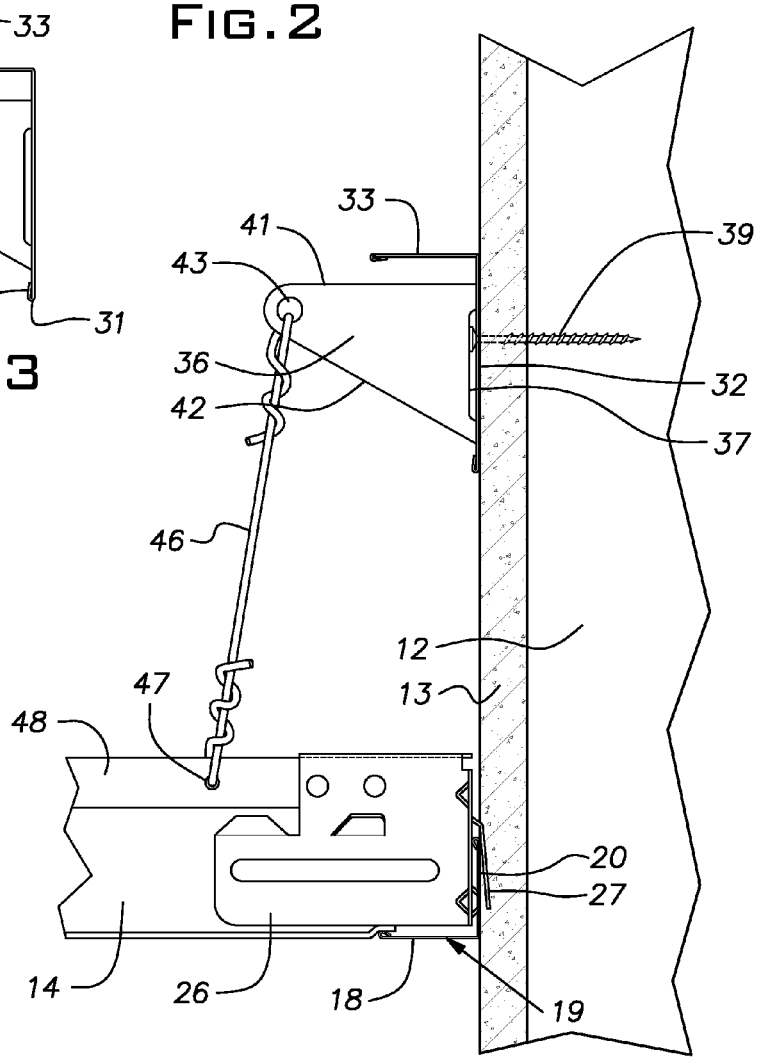
FIG. 4 is a fragmentary elevational view of a grid runner attached to a wire support of the invention.
Figure 7:
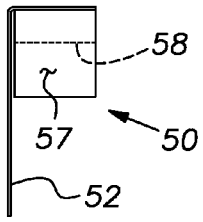
FIG. 7 is a top view of the clip of FIG. 5.
Figure 6:
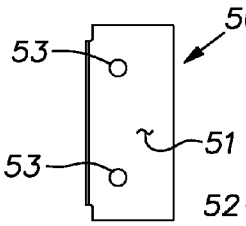
FIG. 6 is a front view of the clip of FIG. 5.
Figure 5:
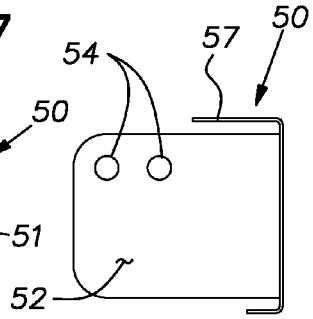
FIG. 5 is a side view of a standoff wire support clip of a second embodiment of the invention.

FIGS. 2-4 illustrate an embodiment of the invention by which a grid runner 14 is supported by a wire attached in close proximity to the runner end. A wall molding or angle 30 depicted in FIGS. 2 and 3 is preferably a roll formed sheet metal unit. The wall molding 30 can be made of, for example, G-30 hot dipped galvanized steel of 0.018/0.021 inch thickness. The wall molding 30 can be supplied in 10 foot lengths, for example. The wall molding 30 is cut to length or joined with like wall moldings to span a wall. Distal longitudinal edges 31 of each wall molding leg or flange 32, 33 is stiffened by an inturned hem 34.

Uniformly spaced along the length of the wall molding 30 are triangular supports 36. The supports 36 are blanked or cut in the vertical leg 32 of the wall molding 30. These supports 36 can be formed on 8 inch centers, for example. A vertical side of a support 36, in major part, is formed by a relatively wide slot 37. Above and below the slot 37 are land portions 38 where the support 36 remains integrally connected with the vertical leg 32. Other side edges 41, 42 of the support 36 are fully severed from the vertical leg 32. A hole 43 is blanked from the support 36 at a distal corner opposite the slot 37.

The wall molding 30 is supplied to a building site with the supports 36 remaining in the plane of the leg 32. Once a layout of a ceiling grid is determined so that the location of the ends of the grid runners intersecting a wall is known, the wall molding 30 can be installed. The wall molding 30 is installed on a wall a predetermined distance above the ceiling grid 16 with the support slots 37 in line with the future or actual centers of the grid runners 14. The supports 36 can be bent and extended perpendicularly to the vertical wall molding leg 32 either before or after the wall molding 30 is installed on a wall. The wall molding 30 can be located lengthwise without regard to the location of wall studs or like structure since fasteners 39, such as drywall screws for securing the wall molding 30 to the wall studs 12 can be situated wherever the studs exist along the length of the wall angle.

A standard suspension wire 46, such as 12 gauge (0.109 in. diameter) steel wire, is looped through a preformed hole 47 in a reinforcing bulb 48 adjacent the end of a grid runner 14 and through the hole 43 in the support 36. The wire 46 is twisted about itself to lock it in position. Since the supports 36 are aligned with the grid runners 14, the wire 46 advantageously lies in a vertical plane through the grid runner thereby avoiding any side thrust on the grid runner as a result of a tension force in the wire. The "standoff" of the wire 46 from the wall 11 provided by the projection of the support 36 from the wall is beneficial. The wire 46 can be readily arranged to not deviate from the vertical by more than 8.5 degrees. With this near vertical orientation of the wire 46, there is negligible horizontal force or thrust developed by tension in the wire even though the wall molding 30 and the support 36 is relatively close to the ceiling plane. The support hole 43 can stand off a wall 1¾ inches, for example.

FIGS. 5-8 illustrate aspects of another embodiment of the invention. Parts in FIGS. 8, 9 and 10 that are identical to those described in connection with FIG. 4 are identified with the same numerals. A support clip or bracket 50 is formed of a single piece of sheet metal, for example, 0.016/0.019 inch gauge hot dipped galvanized steel. In the plan view of FIG. 7, the support clip 50 has a right angle configuration. The clip 50 includes a base plate 51 and a support plate 52. The base plate 51 has a pair of screw receiving holes 53 and the support plate 52 has a pair of holes 54 adapted to receive a suspension wire 46. Upper and lower rectangular tabs 57, 58 extend horizontally from respective upper and lower edges of the base plate 51. The clip 50 is proportioned to mate with a wall molding 60.

The illustrated wall molding 60 is in the form of a U-shaped channel having flanges 61, 62 of unequal width and an intermediate web 63. The wall molding or channel 60 is preferably made from roll formed sheet metal of, for example, 0.016/0.019 inch G-30 hot dipped galvanized steel. The distal longitudinal margins of the flanges 61, 62 have inturned hems 64 terminating at edges 65. The wall molding 60 can be supplied in lengths of 10 foot. By way of example, the wall molding 60 can have a height of 1.862 inches, the upper flange 61 can have a width of 1 inch and the lower flange 62 can have a width of ½ inch. The wall molding 60 can be butt jointed with one or more identical pieces and/or can be cut to suit the length of a particular wall.

The wall molding 60 is secured to a wall 11 such as by self-drilling drywall screws 39 through the web 63, drywall 13 and into studs 12 or other structural wall component. The support clip 50 is proportioned for the base plate 51 and tabs 57, 58 to fit within the wall molding 60. Distal ends of the tabs 57, 58 snap into engagement with the channel hem edges 65 when the base plate 51 is close to or abuts the channel web 63.

The snap-in retention of the support clip 50 in the wall molding 60 afforded by the tabs 57, 58 is a convenience to the installer since the clip need not be held in place while the installer performs related tasks. Ordinarily, the clip 50 is fixed in place with a self-drilling screw 66 located in one of the holes 53 and driven into the wall molding web 63. It will be understood that there is no need for the clip 52 or, more significantly, for the grid runner 14 to be located at a stud center. The wall molding 60, once fixed to the wall, is strong enough to hold the clip 50 when the clip is screwed or otherwise fixed to the molding. The strength of the molding 60 is enhanced by having a flange 61 at the top of the web 63 which greatly improves the resistance of the molding to buckling outward from the wall 11. The clip 50 is tied to a grid runner 14 with a suspension wire 46 by threading the wire through one of the holes 54 and a hole 47 in the reinforcing bulb. As in the situation described in FIG. 4, the support clip 50 supplements the function of a seismic clip 26 and prevents a grid runner 14 from falling if it were to slip off the wall angle 19 during a seismic event.

Figure 8:
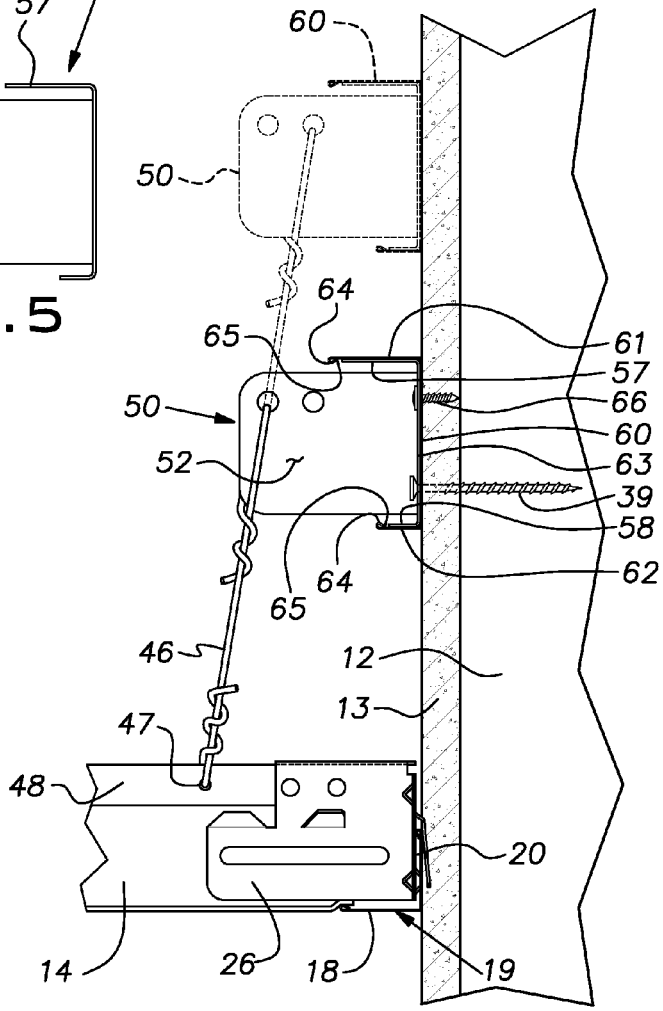
FIG. 8 is a fragmentary elevational view of a grid runner attached to the wire support clip of FIG. 5 mounted in a wall molding.

As shown in phantom in FIG. 8, the wall molding 60 and clip 50 can be installed at a higher elevation relative to the plane of the ceiling 10. In such a case, a suspension wire can be threaded through an inward hole and the wire would be within 8.5 degrees of vertical.

Figure 9:
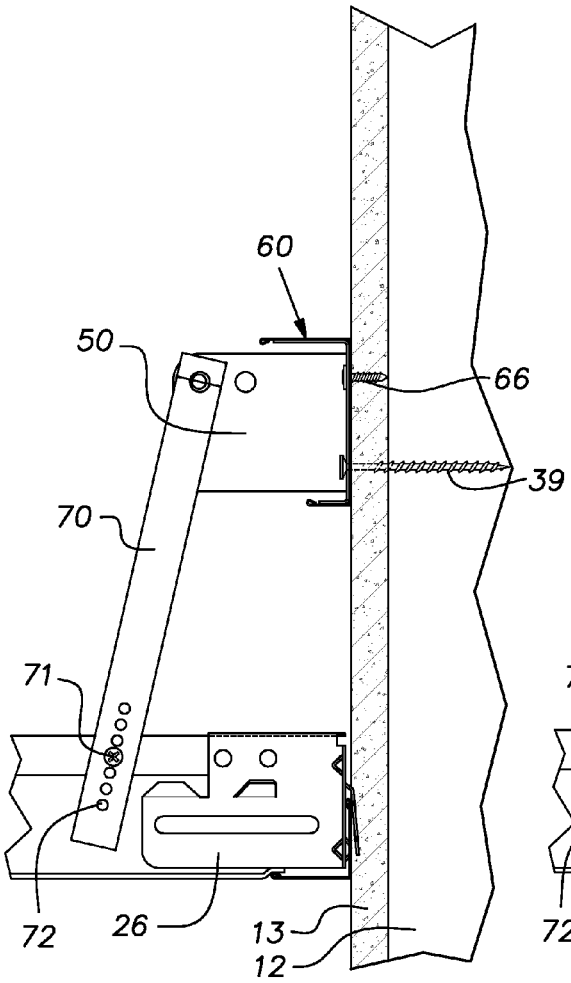
FIG. 9 is a view similar to FIG. 8 with a strap serving the function of a tension wire.

FIG. 9 illustrates a modification where a sheet metal strap 70 is substituted for the wire 46 of FIG. 8. The strap 70 can be permanently pivotally joined with a rivet or other fastening technique to the support plate 52 and can be attached to the reinforcing bulb 48 of a grid runner 14 with a self-drilling screw 71. The screw 71 can be assembled in a selected one of a series of preformed holes 72 in the strap 70. The strap 70 can save labor over the use of the suspension wire 46.

Figure 10:
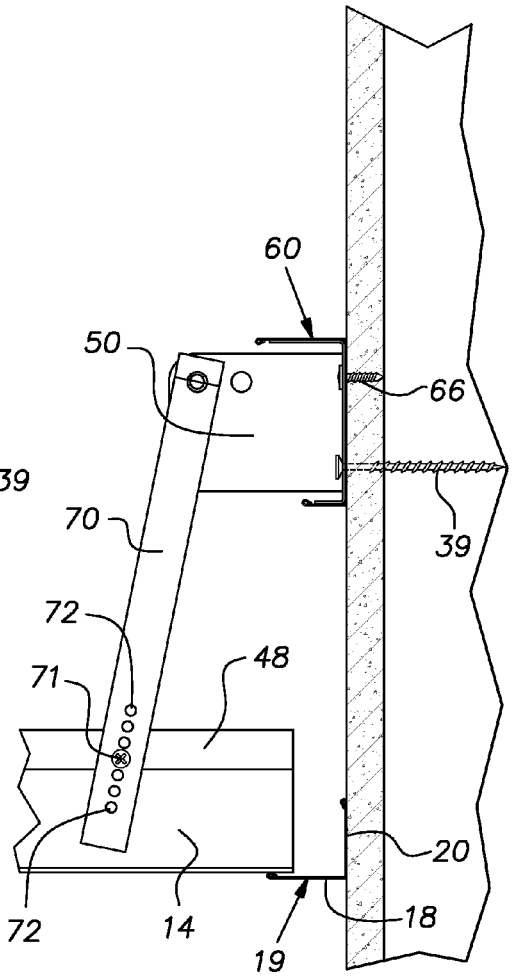
FIG. 10 is a view similar to FIG. 9 with the strap serving as the sole seismic safety support for a grid runner.

FIG. 10 illustrates a situation like that described in connection with FIG. 9 where the seismic clip 26 has been eliminated and exclusive reliance for suspension of the grid runner end is on the strap 70, clip 50 and molding 60.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A seismic duty support system for a suspended ceiling at a wall intersection, the support system comprising an elongated roll formed sheet metal wall molding, the wall molding having a vertical element and a horizontal element unitary with the vertical element at an upper edge of the vertical element, a plurality of sheet metal supports regularly spaced along a length of the wall molding, the supports being cutouts of the vertical element and being attached to and extending perpendicularly from the vertical element a distance greater than a width of the horizontal element, each of said supports lying in a vertical plane perpendicular to the vertical element, each support having a hole distal from the vertical element for cooperating with a tension element connected to the end of an underlying grid runner, each of said supports being attached to said vertical element at locations vertically spaced a distance that is a majority of a distance of the hole from the vertical element.

2. A system as set forth in claim 1, wherein said hole is proportioned to receive a standard suspension wire.

3. A system as set forth in claim 1, including a sheet metal link pivotally connected to the hole of the support and to the end of an underlying grid runner.

4. A seismic duty support system for a suspended ceiling at a wall intersection, the support system comprising an elongated roll formed sheet metal U-shaped channel wall molding, the wall molding having a vertical element and two vertically spaced horizontal elements unitary with the vertical element at upper and lower edges of the vertical element, a plurality of sheet metal supports regularly spaced along a length of the wall molding, the supports each having a base extending from one horizontal element to another horizontal element and being attached to the vertical element, each support having a portion extending perpendicularly from the vertical element a distance greater than a width of either horizontal element, each of said support portions lying in a vertical plane perpendicular to the vertical element, each support portion having a hole distal from the vertical element for cooperating with a tension element connected to the end of an underlying grid runner, each support portion being attached directly to a respective base along a vertical distance that is a majority of a distance of the hole from the vertical element, the channel horizontal elements having inturned hems, the base and support portion being formed separately from the wall molding, the base being configured to fit in the channel and be retained by said hems.

* * * * *